US009107563B2

(12) United States Patent
Ryu

(10) Patent No.: US 9,107,563 B2
(45) Date of Patent: Aug. 18, 2015

(54) DISHWASHER AND BASKET FIXATION APPARATUS

(75) Inventor: Jung Chan Ryu, Suwon-si (KR)

(73) Assignee: SAMSUNG ELECTRONICS CO., LTD., Suwon -Si (KR)

( * ) Notice: Subject to any disclaimer, the term of this patent is extended or adjusted under 35 U.S.C. 154(b) by 552 days.

(21) Appl. No.: 13/600,771

(22) Filed: Aug. 31, 2012

(65) Prior Publication Data

US 2013/0057131 A1 Mar. 7, 2013

(30) Foreign Application Priority Data

Sep. 1, 2011 (KR) ..... 10-2011-0088572

(51) Int. Cl.
*A47L 15/50* (2006.01)

(52) U.S. Cl.
CPC ..... *A47L 15/507* (2013.01); *Y10T 403/591* (2015.01)

(58) Field of Classification Search
CPC ..... A47L 15/50; A47L 15/501; A47L 15/504; A47L 15/506; A47L 15/507; A47L 15/508; F16L 37/086
USPC ..... 134/56 D, 58 D, 57 D, 135, 137, 200; 211/41.8, 41.9, 41.4; 312/228.1; 403/322.1
See application file for complete search history.

(56) References Cited

U.S. PATENT DOCUMENTS

2008/0272074 A1 11/2008 Crookshanks et al.
2010/0126526 A1 5/2010 Poyner et al.

FOREIGN PATENT DOCUMENTS

CA 2358976 A1 * 4/2002
DE 200 22 478 U1 10/2001
KR 10-2006-0100597 9/2006

OTHER PUBLICATIONS

European Search Report dated Jan. 23, 2013 issued in corresponding European Patent Application 12182364.5.

* cited by examiner

*Primary Examiner* — Michael Barr
*Assistant Examiner* — Tinsae Ayalew
(74) *Attorney, Agent, or Firm* — Staas & Halsey LLP

(57) ABSTRACT

A dishwasher capable of fastening a basket of the dishwasher therein using a fixation member and a basket fixation apparatus of the dishwasher, the dishwasher including a body having an opening, a washing tub provided at an inside the body, a basket disposed at an inside the washing tub to store dishware, a stopper disposed to at least one inner side of the washing tub, and a fixation member configured to prevent the basket from being separated from the body and to be able to move between a stop state that one portion of the fixation member is engaged with the stopper and a release state that the fixation member is moved from the stop state for the basket to be withdrawn from the body.

21 Claims, 8 Drawing Sheets

DISHWASHER AND BASKET FIXATION APPARATUS

CROSS-REFERENCE TO RELATED APPLICATIONS

This application claims the priority benefit of Korean Patent Application No. 10-2011-0088572, filed on Sep. 1, 2011 in the Korean Intellectual Property Office, the disclosure of which is incorporated herein by reference.

BACKGROUND

1. Field

Embodiments of the present disclosure relate to a dishwasher, and more particularly, to a dishwasher capable of fixing a basket of a dishwasher therein using a fixation member.

2. Description of the Related Art

In general, a dishwasher is an apparatus configured to spray high-pressure washing water at dishware, and goes through a preliminary washing stage, a main washing stage, a rinsing stage, and a drying stage. During a preliminary washing stage, residue of food on dishware is removed by spraying washing water without detergent being input. During a main washing stage, a washing of dishware is performed as detergent is input by a detergent supply apparatus at the same time when washing water is sprayed.

In general, a dishwasher includes a body having a washing tub therein, a basket installed at an inside the washing tub to be able to move back and forth with respect to the washing tub, and a spray nozzle provided at an upper area and a lower area of the basket to spray washing water so that the washing water sprayed from the spray nozzle washes dishware.

A conventional dishwasher, in order to protect children, is provided with a door locking device or a control lock at a manipulation part furnished thereon. For a door locking device, although the door locking device is configured in a way that an entry of a child from an outside of the dishwasher to an inside of the dishwasher may be prevented, an unexpected accident may occur when a child by mistake entered to an inside the dishwasher when the door is not locked, and may not be able to escape to an outside the dishwasher. In addition, when a control lock, although the control lock is configured in a way that an accident caused by a malfunction as a result of a child abnormally operating a dishwasher may be prevented, an accident may occur when a child manipulates a basket containing dishware and causes the dishware to fall off from the basket.

SUMMARY

Therefore, it is an aspect of the present disclosure to provide a dishwasher having a basket fixation apparatus capable of fixing a basket therein by using a fixation member.

Additional aspects of the disclosure will be set forth in part in the description which follows and, in part, will be apparent from the description, or may be learned by practice of the disclosure.

In accordance with an aspect of the present disclosure, a dishwasher includes a body, a washing tub, a basket, a stopper and a fixation member. The body has an opening. The washing tub is provided at an inside the body. The basket is disposed at an inside the washing tub and configured to store dishware. The stopper is disposed to at least one inner side of the washing tub. The fixation member is installed at the basket and configured to be able to move between a stop state that one portion of the fixation member is engaged with the stopper to prevent the basket from being withdrawn from the body and a release state that the one portion of the fixation member is detached from the stopper for the basket to be withdrawn from the body.

The stopper, in a state when the basket is inserted into an inside the washing tub, is disposed at a rear area with respect to a front portion of the basket.

The dishwasher further includes a manipulation part provided at a front portion of the basket for a user to manipulate the fixation member.

The manipulation part includes a groove provided for the fixation member to move therein.

The dishwasher further includes a handle and a manipulation part. The handle is provided at a front portion of the basket and configured to be grippable for a user to detach/attach the basket. The manipulation part provided at the front portion of the basket is disposed at the handle for a user to manipulate the fixation member.

The fixation member includes a handle coupling part coupled to the handle, a basket coupling part coupled to the basket, and a stopper engaging part engaged with the stopper.

The basket coupling part is further protruded toward a moving direction of the basket than the handle coupling part and the stopper engaging part are protruded toward the moving direction of the basket.

The handle coupling part of the fixation member is configured to vertically penetrate the handle while being vertically bended.

A cap for shock absorption is coupled to a portion of the fixation member, which faces the body.

The dishwasher further includes at least one holder configured to supportively couple the fixation member to the basket.

The holder includes a first fixation groove to which the fixation member is coupled, and a second fixation groove to which the basket is coupled.

The fixation member is installed at one side of the basket.

The fixation member is installed at both sides of the basket.

The fixation member is configured to be changed from the release state to the stop state by performing a horizontal movement.

In accordance with another aspect of the present disclosure, a basket fixation apparatus of a dishwasher, which is configured to prevent a basket of the dishwasher storing dishware from moving, includes a handle, a stopper and a fixation member. The handle is configured to be grippable for a user to detach/attach the basket and disposed at a front portion of the basket. The stopper is disposed at a rear area of the basket. The fixation member is installed at the basket and configured to be able to move between a stop state that one portion of the fixation member is engaged with the stopper to prevent the basket from being withdrawn from the body and a release state that the one portion of the fixation member is separated from the stopper for the basket to be withdrawn from the body.

The fixation member includes a handle coupling part having one side extended to the handle and coupled to a handle, a basket coupling part coupled to the basket, and a stopper engaging part engaged with the stopper.

The basket coupling part is further protruded toward a moving direction of the basket than the handle coupling part and the stopper engaging part are protruded toward the moving direction of the basket.

The basket fixation apparatus further includes at least one holder configured to supportively couple the fixation member to the basket.

The holder includes a first fixation groove to which the fixation member is coupled in a widthwise direction, a second fixation groove to which a portion of a grid-pattern rack forming the basket is coupled in a widthwise direction, and a third fixation groove to which another portion of the grid-pattern rack is coupled in a lengthwise direction.

By preventing a basket from being withdrawn to an outside a dishwasher, a secondary risk that may be occurred from dishware inside the dishwasher falling off from the basket as a result of an abnormal operation of the dishwasher may be prevented, and thereby an accident may be prevented.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
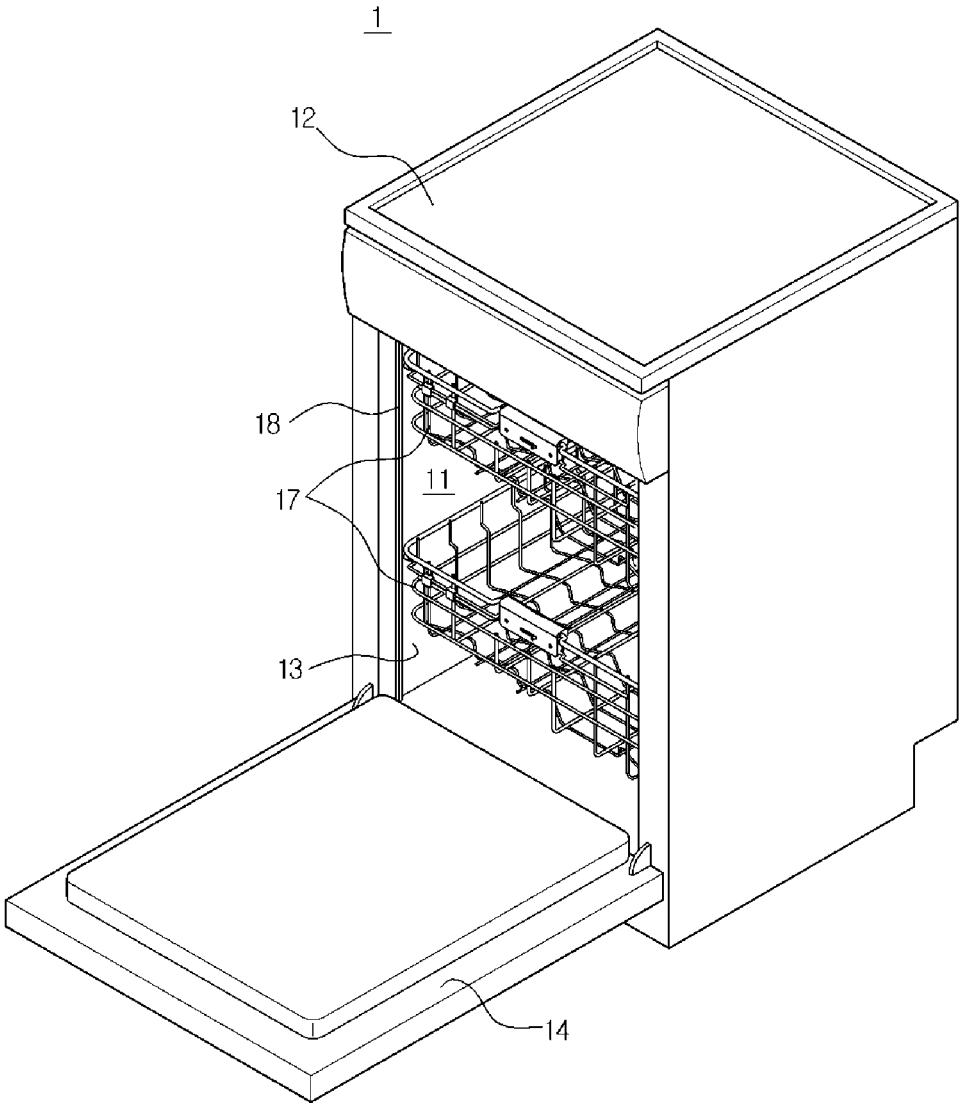
FIG. 1 is a perspective view of a dishwasher according to an embodiment of the present disclosure.

Reference will now be made in detail to embodiments of the present disclosure, examples of which are illustrated in the accompanying drawings, wherein like reference numerals refer to like elements throughout.

FIG. 1 is a perspective view of a dishwasher according to an embodiment of the present disclosure.

As illustrated on FIG. 1, a dishwasher 1 includes a body 12 that forms an exterior and provided at an inside thereof with a washing tub 11 to wash dishware. An opening 13 which opens toward a front direction of the dishwasher is provided at a front side of the body 12 to insert or withdraw dishware into/from the washing tub 11. A door 14 having a lower end hinged to a bottom portion of the front side of the body 12 is installed at a front side of the body 12 to open/close the opening 13.

The door 14 is provided with a display (not shown) showing an operation state of the dishwasher 1 and a manipulation part (not shown) configured to control an operation state of the dishwasher 1.

A plurality of baskets 17 each provided with an accommodation part having an upper side open to store dishware, is installed at an upper portion and a lower portion of the washing tub 11 in a manner that each one of the plurality of baskets 17 may be pulled out from and/or pushed into the washing tub 11. The plurality of baskets 17 may be withdrawn from or inserted into through the front side of the body 12 that is open In addition, a plurality of water spray nozzles (not shown) is rotatively installed at an upper side and a lower side of the plurality of baskets 17 to spray water for the dishware stored at the plurality of baskets 17 to be washed. At this time, the plurality of baskets 17 is formed with a wire disposed in a grid shape for the water sprayed from the plurality of water spray nozzles (not shown) to reach at the dishware and wash the dishware stored therein.

Figure 2:
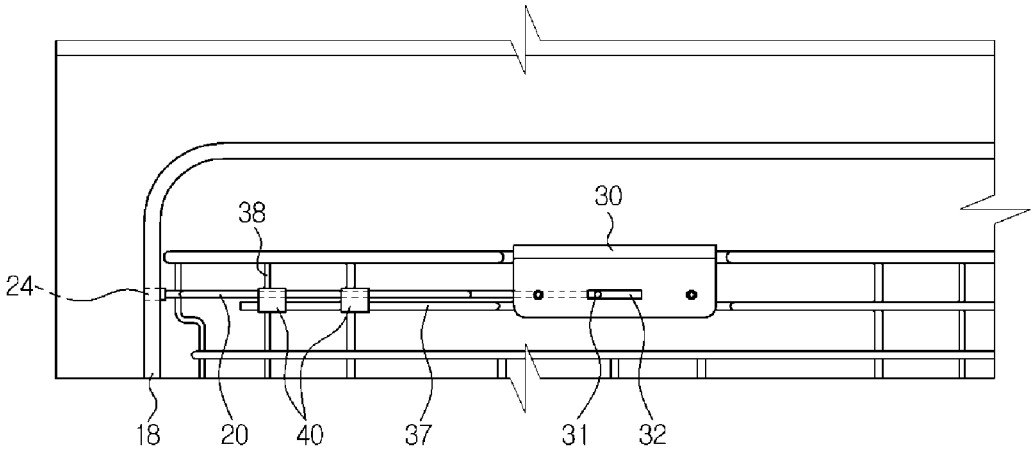
FIG. 2 is a view illustrating a state when a fixation member of the dishwasher is engaged at a stopper according to an embodiment of the present disclosure.
Figure 3:
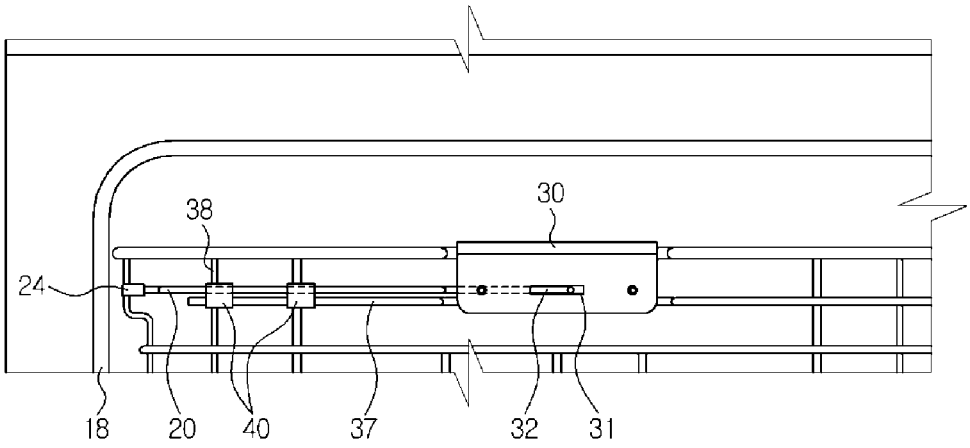
FIG. 3 is a view illustrating a state when a fixation member of the dishwasher is not engaged at a stopper according to an embodiment of the present disclosure.

FIG. 2 is a view illustrating a state when a fixation member of the dishwasher is engaged at a stopper according to an embodiment of the present disclosure. FIG. 3 is a view illustrating a state when a fixation member of the dishwasher is not engaged at a stopper according to an embodiment of the present disclosure.

As illustrated on FIGS. 2 to 3, the washing tub 11 includes a stopper 18 disposed on at least one inner side of the washing tub 11. The stopper 18 is protruded from the inner side of the washing tub 11 to a direction at which the basket 17 is positioned. A fixation member 20 is provided at a front portion of the basket 17, and when the basket 17 is moved to an outside of the body 12 of the dishwasher 1, configured to be engaged by the stopper 18 to prevent the basket 17 from moving to an outside of the body 12. One end of the fixation member 20 is extended toward the stopper 18, while the other end of the fixation member 20 is extended toward a handle 30. The handle 30, similar to the fixation member 20, is disposed at the front portion of the basket 17, and may function as a grip.

The fixation member 20 is capable of conducting a stop state that the fixation member 20 is positioned as to enable engagement with the stopper 18 and thus the movement of the basket 17 may be stopped, and a release state that the fixation member 20 is positioned as not to be engaged with the stopper 18 and thus the basket 17 may be moved to an outside the body 12 of the dishwasher 1. That is, the fixation member 20 is moved toward the inner wall of the washing tub 20 and is stopped by the stopper 18 in the stop state, and the fixation member 20 is moved toward a direction of the basket 17 in the release state.

In accordance with the drawing, the fixation member 20 is movably installed while able to move horizontally either to a left or right. However, the movement of the fixation member 20 is not limited to the horizontal movement, but may be able to move vertically.

At least one holder 40 is installed on the fixation member 20 is coupled to the basket 17, and the holder 40 will be explained later.

The fixation member 20 may be formed using a nylon-coated metal material, aluminum material, or plastic material but not limited hereto, and other material having similar function may also be used.

Figure 4:
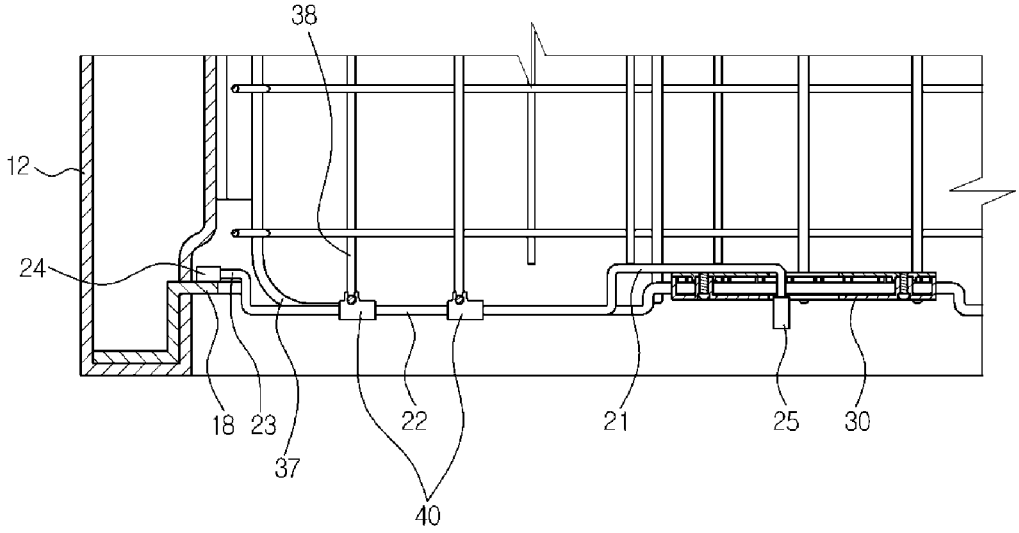
FIG. 4 is a cross section view illustrating the fixation member of the dishwasher coupled to a basket according to an embodiment of the present disclosure.
Figure 5:
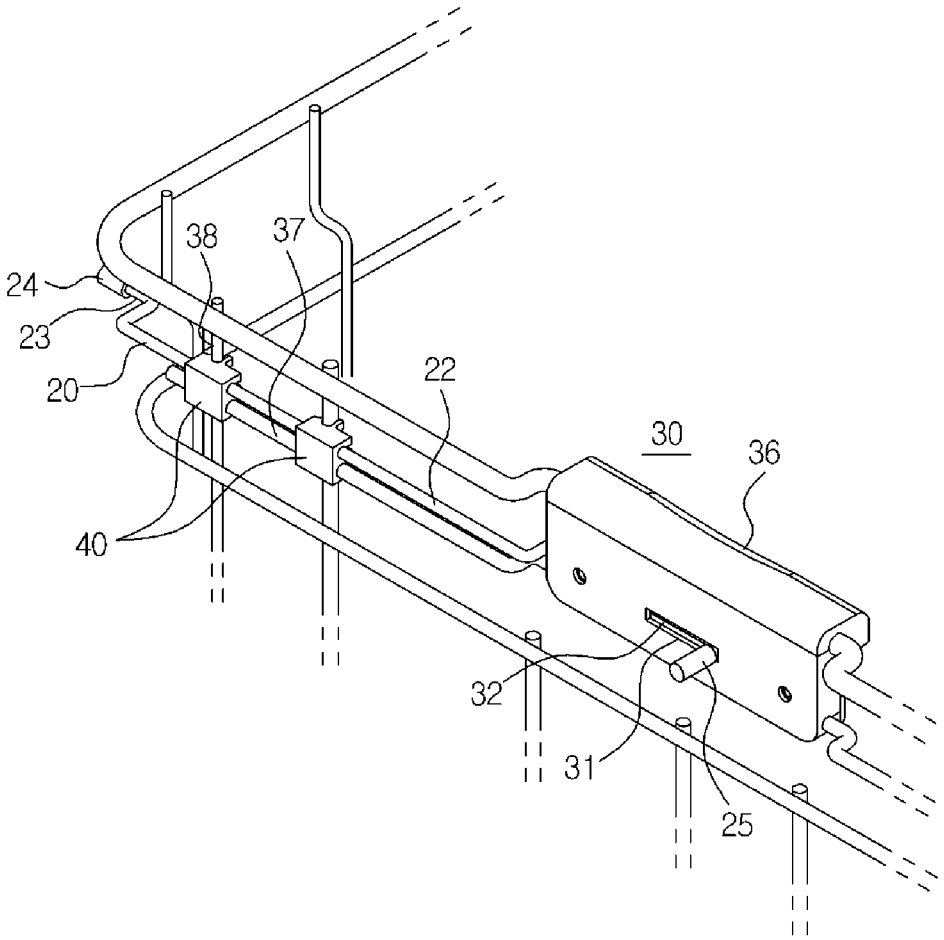
FIG. 5 is a view illustrating a state when the fixation member of the dishwasher is coupled to the basket according to an embodiment of the present disclosure.
Figure 6:
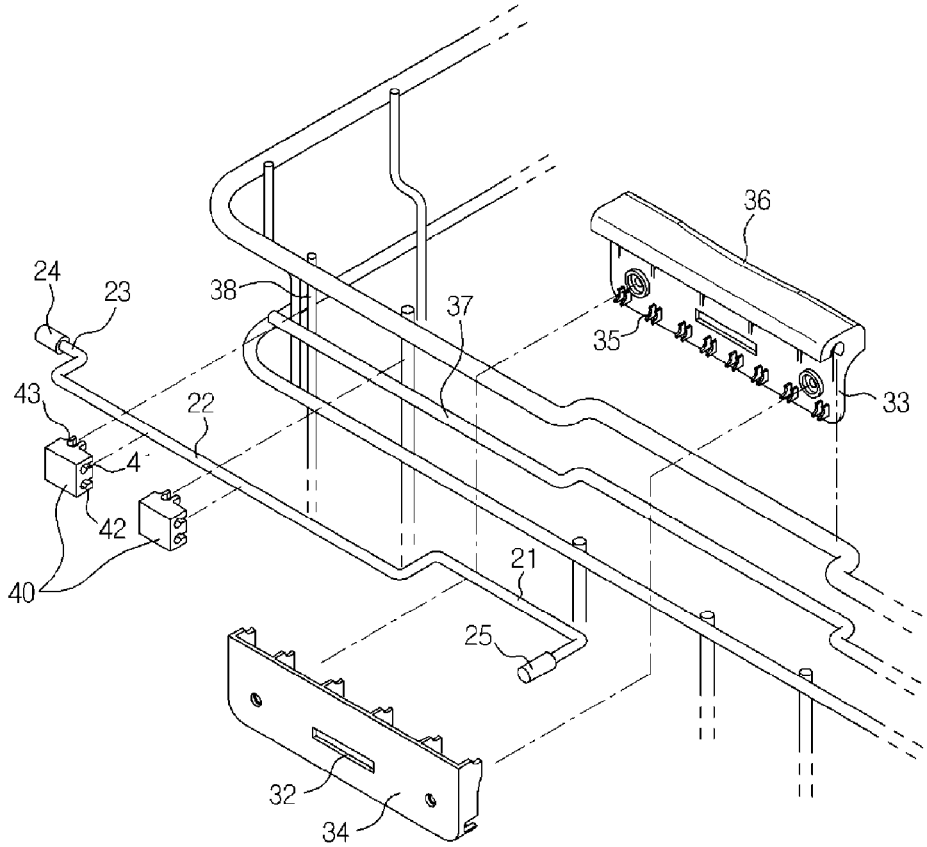
FIG. 6 is an exploded view illustrating the fixation member, a handle, and a holder of the dishwasher according to an embodiment of the present disclosure.

FIG. 4 is a cross section view illustrating the fixation member of the dishwasher coupled to a basket according to an embodiment of the present disclosure. FIG. 5 is a view illustrating a state when the fixation member of the dishwasher is coupled to the basket according to an embodiment of the present disclosure. FIG. 6 is an exploded view illustrating the fixation member, a handle, and a holder of the dishwasher according to an embodiment of the present disclosure.

As illustrated on FIGS. 4 to 6, the fixation member 20 includes a handle coupling part 21 coupled to the handle 30, a basket coupling part 22 coupled to the basket 17, and a stopper engaging part 23 engaged with the stopper 18. The basket coupling part 22 is further protruded to a direction toward an outer side of the dishwasher 1 compared to the handle coupling part 21 is protruded, so that the fixation member 20 may be smoothly coupled to the handle 30. In addition, since the stopper engaging part 23 is engaged at an inner side the stopper 18, the stopper engaging part 23 is bended toward an inner side the body 12 from the basket coupling part 22.

The stopper engaging part 23 of the fixation member 20 is moved toward a rear of the stopper 18 to prevent the basket 17 from moving to outside the body 12. In addition, a cap 24, a shock absorption member made with rubber material, is coupled to the stopper coupling part 23 to moderate a noise and a friction caused by collision between the fixation member 20 and the stopper 18 in the stop state.

The controlling of the stop state and the release state of the fixation member 20 may be performed through a manipulation part 31. In accordance with an embodiment of the present disclosure, the manipulation part 31 may be positioned on the handle 30. The handle 30 may be provided at a side with a groove 32 in which the fixation member 20 is moved.

The handle coupling part 21 of the fixation member 20 is installed on the handle 30, and an end portion of the handle coupling part 21 is bended in 90° to a direction toward an outer side of the body 12 to be protruded to the groove 32 provided on the handle 30. In accordance with an embodiment of the present disclosure, the fixation member 20 may be controlled at the stop state or the release state by moving the handle coupling part 21 of the fixation member 20 protruded through the groove 32 horizontally either to a left or right. A fixation member gripping part 25 may be installed on the handle coupling part 21 for a user to hold the fixation member gripping part 25 and easily move the fixation member 20.

At least one holder 40 may be installed on the basket coupling part 22 of the fixation member 20 to fix the fixation member 20 to the basket 17. The fixation member 20 is coupled to the basket 17 through the holder 40. The stopper engaging part 23 of the fixation member 20, while the fixation member 20 is at the stop state, is engaged at a rear of the stopper 18 that is protruded at an inner side of the body 12.

In addition, the basket coupling part 22 of the fixation member 20 is coupled to the basket 17 through the holder 40. As long as at least one holder 40 serves to couple the basket coupling part 22 of the fixation member 20 to the basket 17, the number of the holder 40 is not limited, although the total of two units of the holder 40 are coupled on the drawing, as an example.

The basket coupling part 22 of the fixation member 20, since the basket coupling part 22 of the fixation member 20 is further protruded in a direction toward an outer side of the body 12, may be easily coupled to the basket 17.

The holder 40 is provided with a plurality of grooves in a horizontal direction thereon. In addition, the holder 40 may be provided with an additional vertical groove or grooves. A groove among the plurality of horizontal grooves at which the fixation member 20 is coupled to is referred to as a first fixation groove 41. In addition, a groove among the plurality of horizontal grooves at which the basket 17 is coupled to is referred to as a second fixation groove 42. The first fixation groove 41 may be located above or below the second fixation groove 42 so that the fixation member 20 may be coupled to the upper horizontal groove or the lower horizontal groove of the holder while the basket 17 is coupled to the lower horizontal groove or the upper horizontal groove of the holder. The groove formed in a vertical direction is referred to as a third fixation groove 43. The fixation member 20 is loosely fastened to the first fixation groove 41 to be able to move, and the basket 17 is firmly fastened to the second fixation groove 42 while being coupled to the second fixation groove 42.

Thus, a rack having a vertical direction and a rack having a horizontal direction, among racks forming the basket 17, are coupled to the holder 40. The rack having a horizontal direction may be defined as a first rack part 37, and the rack having a vertical direction may be defined as a second rack part 38. The fixation member 20 is fixed to the basket 17 as the basket coupling part 22 of the fixation member 20 is coupled to the first fixation groove 41 of the holder 40 and the first rack part 37 is coupled to the second fixation groove 42 of the holder 40. In addition, the second rack part 38 is coupled to the third fixation groove 43 of the holder 40.

The basket 17 may be coupled to the fixation member 20 even when the fixation member 20 is coupled to the holder 40 and either the first rack part 37 or the second rack part 38 of the basket 17 is coupled to the holder 40. However, the holder 40 in accordance with an embodiment of the present disclosure simultaneously couples the fixation member 20 to the first rack part 37 and the second rack part 38 of the basket 17, thereby improving the strength of the coupling between the basket 17 and the fixation member 20.

The handle coupling part 21 of the fixation member 20 is coupled to the handle 30. The handle coupling part 21 of the fixation member 20 is configured to penetrate an inside of the handle 30. The handle 30 includes a handle body 33 and a handle cover 34, and the handle body 33 and the handle cover 34 may be coupled to each other by using a plurality of engaging protrusions 35 provided at each of the handle body 33 and the handle cover 34.

In addition, a gripping part 36 having a middle part cut out is provided at an upper side of the handle 30. The middle portion of the gripping part 36 is cut out in a recess for a user to easily move the basket 17 back and forth. A user, when the fixation member 20 is in the release state, may grab the gripping part 36 to move the basket 17 to an outside the body 12 and then place dishware to the dishwasher 1.

Figure 7:
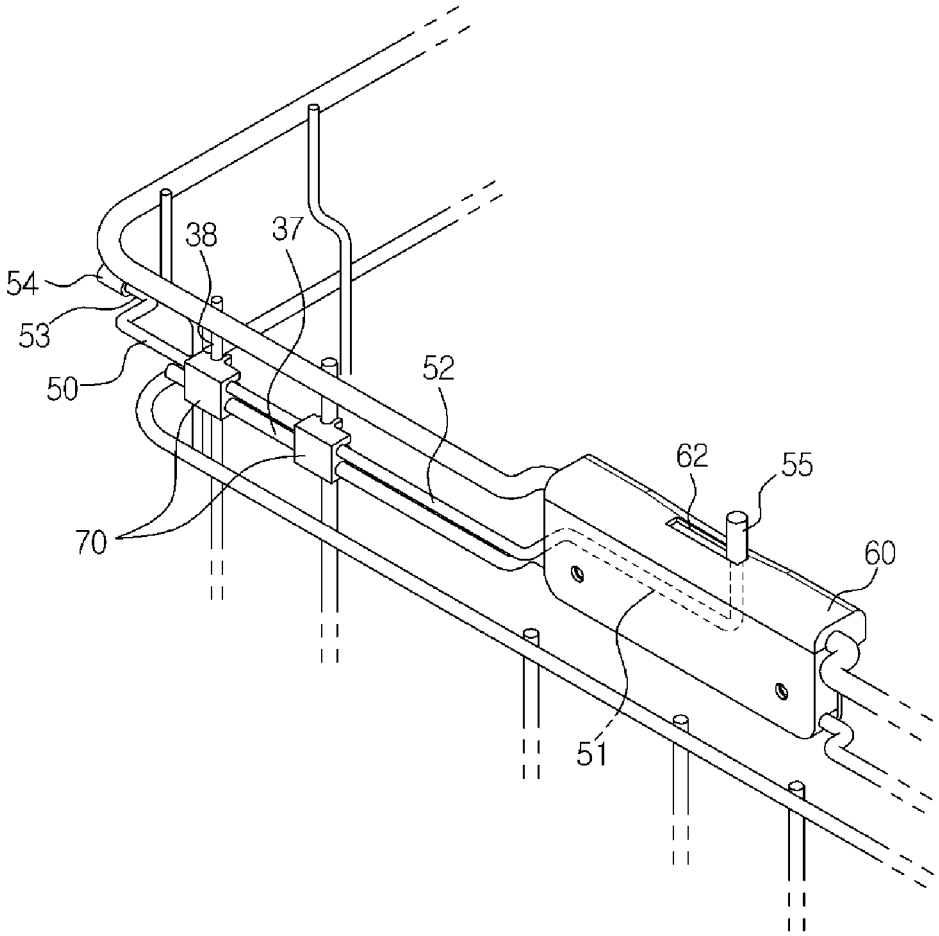
FIG. 7 is a view illustrating a fixation member and a handle of a dishwashing machine according to another embodiment of the present disclosure.

FIG. 7 is a view illustrating a fixation member and a handle of a dishwashing machine according to another embodiment of the present disclosure.

As illustrated on FIG. 7, another embodiment of the present disclosure is different with respect to the position of a manipulation part 61 provided on a handle 60.

A holder 70 is provided with a plurality of grooves in a horizontal direction thereon to be coupled with the rack of the basket 17. In addition, the holder 70 may be provided with an additional vertical groove or grooves to be coupled with the rack of the basket 17. A fixation member 50 includes a handle coupling part 51 coupled to the handle 60, a basket coupling part 52 coupled to the basket 17, and a stopper engaging part 53 engaged with the stopper 18. A cap 54, a shock absorption member made with rubber material, is coupled to the stopper coupling part 53 to moderate a noise and a friction caused by collision between the fixation member 50 and the stopper 18 in the stop state.

The manipulation part 61 may be provided at the upper side of the handle 60. A groove 62 of the handle 60 is provided at an upper side of the handle 60. The end portion of a handle coupling part 51 of a fixation member 50 is bended in a vertical direction to penetrate the groove 62 provided at the upper side of the handle 60. The handle coupling part 51 of the fixation member 50 penetrates the groove 62 of the handle 60, and a user moves the handle coupling part 51 in a horizontal direction either to a left or right to control the fixation member 50 at the stop state or at the release state.

A fixation member gripping part 55 may be installed on the handle coupling part 51 for a user to hold the fixation member gripping part 55 and easily move the fixation member 50. When the manipulation part 61 is provided at the upper side of the handle 60, instead of the front side of the handle 60, the door 14 is prevented from interfering with the fixation member 50 protruded through the groove 62 of the handle 60. Thus, less stress is applied to the fixation member 50, and a possibility of a breakdown is reduced, thereby increasing a lifespan of a product. In addition, since the manipulation part 61 is not provide at the front side of the dishwasher 1, a possibility of a child touching the manipulation part 61 is further reduced.

Further, the manipulation part may be provided at the rear side or the lower side of the handle. The operation of the manipulation part is similar to the ones shown in previous embodiments except that the manipulation part is hidden in the back side of the handle. As the manipulation part is in the rear side of the handle, it may prevent children from accessing and operating the manipulation part.

Figure 8:
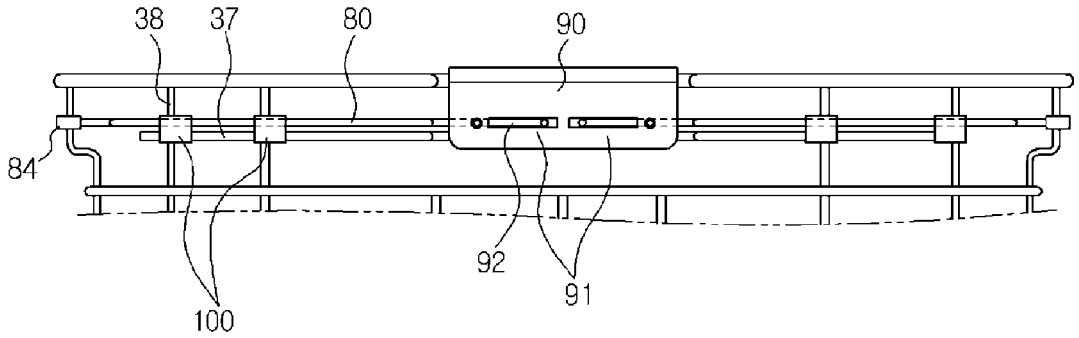
FIG. 8 is a view illustrating a fixation member and a handle of a dishwasher according to another embodiment of the present disclosure.

FIG. 8 is a view illustrating a fixation member and a handle of a dishwasher according to another embodiment of the present disclosure.

A fixation member 80 is provided at both sides of a front portion of the basket 17. A cap 84 may be provided at one end of the fixation member 80. Each fixation member 80 is horizontally moved to a lateral side of the body 12 provided with the stopper 18. Each fixation member 80 maintains the stop state by being engaged at an inner side of the stopper 18. That is, a plurality of units of the fixation member 80 is horizontally moved in opposite direction to each other, and prevent the basket 17 from being withdrawn to an outside the body 12.

A manipulation part 91 is configured to individually control each of the plurality of units of the fixation member 80. Therefore, a plurality of units of groove 92 for the plurality of fixation members 80 are disposed at the handle 90 for the plurality of units of fixation member 80 to penetrate through the handle 90. Each fixation member 80 penetrates the handle 90. In addition, since the end portion of the handle coupling part 81 of each of the fixation member 80 is protruded to a direction toward an outer side of the body 12, the fixation member 80 is protruded through the groove 92 provided on the handle 90. A user, by moving each fixation member 80 protruded, may be able to fasten the basket 17.

Since the both sides of the basket 17 may be fastened, the basket 17 may be stably fastened. In addition, since the weight of the basket 17 is carried by the plurality of units of the fixation member 80 not by a single fixation member 80, a possibility of the breakdown of the fixation member 80 or a holder 100 is also reduced.

Although in FIG. 8, the plurality of manipulation parts are provided at the front side of the handle, the present disclosure is not limited thereto. The plurality of manipulation parts may be provided at the upper side or the rear side of the handle.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dishwasher, comprising:

a body having an opening;

a washing tub provided at an inside the body;

a basket disposed at an inside the washing tub and configured to store dishware;

a stopper disposed to at least one inner side of the washing tub; and a fixation member installed at the basket and configured to be able to move between a stop state that one portion of the fixation member is engaged with the stopper to prevent the basket from being withdrawn from the body and a release state that the one portion of the fixation member is detached from the stopper for the basket to be withdrawn from the body.

2. The dishwasher of claim 1, wherein the stopper, in a state when the basket is inserted into an inside of the washing tub, is disposed at a rear area with respect to a front portion of the basket.

3. The dishwasher of claim 1, further comprising a manipulation part provided at a front portion of the basket for a user to manipulate the fixation member.

4. The dishwasher of claim 3, wherein the manipulation part comprises a groove provided for the fixation member to move therein.

5. The dishwasher of claim 1, further comprising:

a handle provided at a front portion of the basket and configured to be grippable for a user to detach/attach the basket, and a manipulation part provided at a front side of the handle for a user to manipulate the fixation member.

6. The dishwasher of claim 5, wherein the fixation member comprises a handle coupling part coupled to the handle, a basket coupling part coupled to the basket, and a stopper engaging part engaged with the stopper.

7. The dishwasher of claim 6, wherein the basket coupling part is further protruded toward a moving direction of the basket than the handle coupling part and the stopper engaging part are protruded toward the moving direction of the basket.

8. The dishwasher of claim 6, wherein the handle coupling part of the fixation member is configured to vertically penetrate the handle while being vertically bended.

9. The dishwasher of claim 1, wherein a cap for shock absorption is coupled to a portion of the fixation member, which faces the body.

10. The dishwasher of claim 1, further comprising at least one holder configured to supportively couple the fixation member to the basket.

11. The dishwasher of claim 10, wherein the holder comprises a first fixation groove to which the fixation member is coupled, and a second fixation groove to which the basket is coupled.

12. The dishwasher of claim 1, wherein the fixation member is installed at one side of the basket.

13. The dishwasher of claim 1, wherein the fixation member is installed at both sides of the basket.

14. The dishwasher of claim 1, wherein the fixation member is configured to be changed from the release state to the stop state by performing a horizontal movement.

15. A basket fixation apparatus of a dishwasher, which is configured to prevent a basket of the dishwasher storing dishware from moving, the dishwasher comprising:

a handle configured to be grippable for a user to detach/attach the basket and disposed at a front portion of the basket;

a stopper disposed at a rear area of the basket; and a fixation member installed at the basket and configured to be able to move between a stop state that one portion of the fixation member is engaged with the stopper to prevent the basket from being withdrawn from the body and a release state that the one portion of the fixation member is separated from the stopper for the basket to be withdrawn from the body.

16. The basket fixation apparatus of claim 15, wherein the fixation member comprises a handle coupling part having one side extended to the handle and coupled to a handle, a basket coupling part coupled to the basket, and a stopper engaging part engaged with the stopper.

17. The basket fixation apparatus of claim 15, wherein the basket coupling part is further protruded toward a moving direction of the basket than the handle coupling part and the stopper engaging part are protruded toward the moving direction of the basket.

18. The basket fixation apparatus of claim 15, further comprising at least one holder configured to supportively couple the fixation member to the basket.

19. The basket fixation apparatus of claim 18, wherein the holder comprises a first fixation groove to which the fixation member is coupled in a widthwise direction, a second fixation groove to which a portion of a grid-pattern rack forming the basket is coupled in a widthwise direction, and a third fixation groove to which another portion of the grid-pattern rack is coupled in a lengthwise direction.

20. The dishwasher of claim 1, further comprising:

a handle provided at a front portion of the basket and configured to be grippable for a user to detach/attach the basket, and a manipulation part provided at an upper side of the handle for a user to manipulate the fixation member.

21. The dishwasher of claim 1, further comprising:

a handle provided at a front portion of the basket and configured to be grippable for a user to detach/attach the basket, and a manipulation part provided at a rear side of the handle for a user to manipulate the fixation member.

* * * * *

UNITED STATES PATENT AND TRADEMARK OFFICE

CERTIFICATE OF CORRECTION

PATENT NO. : 9,107,563 B2
APPLICATION NO. : 13/600771
DATED : August 18, 2015
INVENTOR(S) : Jung Chan Ryu It is certified that error appears in the above-identified patent and that said Letters Patent is hereby corrected as shown below:

Title Page,

Second Column, (57) Abstract, Line 4

After “inside” insert --of--.

Second Column, (57) Abstract, Line 5

After “inside” insert --of--.

Claims

Claim 1, Column 7, Line 60

After “inside” insert --of--.

Claim 1, Column 7, Line 61

After “inside” insert --of--.

Signed and Sealed this
Ninth Day of February, 2016

Michelle K. Lee

Michelle K. Lee
*Director of the United States Patent and Trademark Office*